US009374644B2

(12) United States Patent
Kasai

(10) Patent No.: US 9,374,644 B2
(45) Date of Patent: Jun. 21, 2016

(54) ACOUSTIC TRANSDUCER AND MICROPHONE

(71) Applicant: OMRON Corporation, Kyoto-shi, Kyoto (JP)

(72) Inventor: Takashi Kasai, Shiga (JP)

(73) Assignee: OMRON Corporation, Kyoto (JP)

( * ) Notice: Subject to any disclaimer, the term of this patent is extended or adjusted under 35 U.S.C. 154(b) by 0 days.

(21) Appl. No.: 14/481,249

(22) Filed: Sep. 9, 2014

(65) Prior Publication Data

US 2015/0078591 A1 Mar. 19, 2015

(30) Foreign Application Priority Data

Sep. 13, 2013 (JP) ..... 2013-191149

(51) Int. Cl.

| | |
|---|---|
| ***H04R 25/00*** | (2006.01) |
| ***H04R 19/04*** | (2006.01) |
| ***H04R 19/00*** | (2006.01) |
| ***H04R 31/00*** | (2006.01) |
| *H04R 1/24* | (2006.01) |
| *H04R 1/08* | (2006.01) |

(52) U.S. Cl.

CPC ..... *H04R 19/04* (2013.01); *H04R 19/005* (2013.01); *H04R 31/00* (2013.01); *H04R 1/086* (2013.01); *H04R 1/245* (2013.01)

(58) Field of Classification Search

CPC ..... H04R 1/245; H04R 7/06; H04R 19/005; H04R 19/04; H04R 2201/003

See application file for complete search history.

(56) References Cited

U.S. PATENT DOCUMENTS

| | | | | |
|---|---|---|---|---|
| 8,934,649 | B1 * | 1/2015 | Lee | H04R 19/005 381/174 |
| 9,036,838 | B2 * | 5/2015 | Chen | H04R 7/16 381/174 |
| 2012/0213400 | A1 * | 8/2012 | Kasai | H04R 19/04 381/369 |

FOREIGN PATENT DOCUMENTS

| | | | | |
|---|---|---|---|---|
| IT | WO 2012093598 | A1 * | 7/2012 | H04R 19/005 |
| JP | 2012-147115 | A | 8/2012 | |
| JP | 5049312 | B2 | 10/2012 | |

* cited by examiner

*Primary Examiner* — Jesse Elbin
*Assistant Examiner* — Ryan Robinson
(74) *Attorney, Agent, or Firm* — Osha Liang LLP

(57) ABSTRACT

An acoustic transducer has a vibrating film and a fixed film formed above an opening portion of a substrate, and at least a first sensing portion and a second sensing portion that detect sound waves using change in capacitance between a vibrating electrode provided in the vibrating film and a fixed electrode provided in the fixed film, convert the sound waves into electrical signals, and output the electrical signals. In the first sensing portion and the second sensing portion, the fixed film is used in common, and the vibrating electrode is divided into a first sensing region and a second sensing region that respectively correspond to the first sensing portion and the second sensing portion. In the first sensing portion, a protrusion portion that protrudes toward the vibrating electrode is provided on a region of the fixed film that opposes the first sensing region.

16 Claims, 8 Drawing Sheets

ACOUSTIC TRANSDUCER AND MICROPHONE

BACKGROUND

1. Field

The present invention relates to an acoustic transducer that detects sound waves using change in the capacitance between a vibrating electrode and a fixed electrode, converts the sound waves into an electrical signal, and outputs the electrical signal.

2. Related Art

Conventionally, an ECM (Electret Condenser Microphone) that employs an electret has been widely used as a small-size microphone for installation in a mobile phone device or the like. However, since charge retention in an electret is easily influenced by a hot atmosphere during microphone manufacturing, there have been cases where maintaining sufficient quality is difficult. This has led to an understanding of the superiority of MEMS microphones, which employ capacitor-type acoustic transducers that detect sound waves and convert them into an electrical signal (detection signal). Note that this acoustic transducer is also called a MEMS microphone since it is manufactured using MEMS technology.

The wider the compatible sound pressure range (dynamic range) of detectable sound waves is in a microphone, the more convenient and useful the microphone is. The dynamic range is defined by the highest compatible sound pressure (acoustic overload point, which is referred to hereinafter as the "AOP"), which is determined by the harmonic distortion rate (total harmonic distortion, which is referred to hereinafter as the "THD"), and the lowest compatible sound pressure, which is determined by the signal-to-noise ratio. When a microphone attempts to detect a sound having a high sound pressure in the vicinity of the highest compatible sound pressure, harmonic distortion occurs in the output signal, and the sound quality deteriorates. In view of this, for example, JP 2012-147115A discloses technology in which, in an acoustic transducer having a fixed electrode and a vibrating electrode that oppose each other, the main portion of the vibrating electrode is divided by a slit so as to divide the capacitor structure in the acoustic transducer into a high-sensitivity variable capacitor and a low-sensitivity variable capacitor, thus widening the dynamic range of the microphone.

Also, as technology for improving the signal-to-noise ratio and lowering the lowest compatible sound pressure, JP 5049312B discloses technology in which a floating type of vibrating electrode is configured in an acoustic transducer for a MEMS microphone. In this technology, the vibrating electrode is arranged in a free state when the microphone is not being used since a voltage is not applied to the vibrating electrode and the fixed electrode, but when a voltage is applied to the two electrodes to perform sound wave detection, electrical attraction occurs between the electrodes, and the vibrating electrode becomes positioned and fixed against the fixed film in a state in which the vibrating electrode abuts against protrusion portions provided on the fixed film side. This improves the sensitivity of the microphone, which as a result enables realizing favorable acoustic characteristics with a good signal-to-noise ratio.

JP 2012-147115A and JP 5049312B are examples of background art.

SUMMARY

In an acoustic transducer that detects sound waves using change in the capacitance between a vibrating electrode and a fixed electrode, converts the sound waves into an electrical signal, and outputs the electrical signal, merely dividing the capacitor structure into a high-sensitivity variable capacitor and a low-sensitivity variable capacitor as in conventional technology makes it possible to widen the dynamic range of the microphone, but there is thought to be room for improvement in terms of the acoustic characteristics. The relative fixed state of the vibrating electrode relative to the fixed film in an acoustic transducer can have not a small influence on the acoustic characteristics.

In view of this, according to floating type of vibrating electrode fixing technique, the vibrating electrode is positioned and fixed against the fixed film when detecting sound waves, thus making it possible to suppress internal stress in the vibrating electrode during sound wave detection and therefore obtain favorable acoustic characteristics in the acoustic transducer. In particular, the lowest compatible sound pressure can be lowered by improving the signal-to-noise ratio. However, raising the highest compatible sound pressure is difficult in the case of the floating type of fixing technique. This is because the vibrating electrode is held by electrical attraction acting between the electrodes, and therefore when the sound pressure is comparatively high, the holding force weakens, and there is the risk of the high sound pressure causing misalignment or separation of the vibrating electrode from the fixed electrode and generating distortion in the sound wave detection signal.

An acoustic transducer according to one or more embodiments of the present invention detects sound waves using change in the capacitance between a vibrating electrode and a fixed electrode, converts the sound waves into an electrical signal, and outputs the electrical signal, and furthermore can realize favorable acoustic characteristics and as wide a dynamic range as possible in a microphone.

In an acoustic transducer of one or more embodiments of the present invention, a vibrating film and a fixed film are formed above an opening portion in a substrate, sound waves are detected using change in capacitance between the vibrating electrode and the fixed electrode in the films, the sound waves are converted into electrical signal, and the electrical signals are output, and in this acoustic transducer, at least two sensing portions having different sensitivities are provided and, according to one or more embodiments of the present invention, a floating type of fixing technique is applied as the technique for fixing the vibrating electrode in the high-sensitivity sensing portion, and a technique of directly fixing the vibrating electrode to the substrate or the fixed film is applied in the low-sensitivity sensing portion. This enables obtaining favorable sensitivity to sound pressure in the respective sensing portions, thus making it possible to obtain balance in the dynamic range and the acoustic characteristics.

Specifically, an acoustic transducer of one or more embodiments of the present invention includes: a vibrating film and a fixed film formed above an opening portion of a substrate; and at least a first sensing portion and a second sensing portion that detect sound waves using change in capacitance between a vibrating electrode provided in the vibrating film and a fixed electrode provided in the fixed film, convert the sound waves into electrical signals, and output the electrical signals, wherein in the first sensing portion and the second sensing portion, the fixed film is used in common, and the vibrating electrode is divided into a first sensing region and a second sensing region that respectively correspond to the first sensing portion and the second sensing portion. In the first sensing portion, a protrusion portion that protrudes toward the vibrating electrode is provided on a region of the fixed film that opposes the first sensing region, and the first sensing portion is configured such that when voltage is applied between the fixed electrode and the vibrating electrode, the vibrating film comes into contact with the protrusion portion such that the first sensing region of the vibrating electrode is relatively fixed to the fixed film in a state in which an air gap that is a first predetermined gap is formed between the fixed electrode and the vibrating electrode, and when the voltage application is canceled, the relative fixed state of the first sensing region is also canceled, and in the second sensing portion, the vibrating film in the second sensing region is fixed to the substrate or the fixed film in a state in which an air gap that is a second predetermined gap is formed between the fixed electrode and the vibrating electrode.

The acoustic transducer of one or more embodiments of the present invention detects sound waves based on a change in the capacitance between the fixed electrode and the vibrating electrode provided in the vibrating film that vibrates due to detected sound waves, converts the sound waves into electrical signals, and outputs the electrical signals. In order for the fixed film to be less likely to vibrate due to sound waves than the vibrating film is, or to substantially not vibrate due to sound waves, the fixed film is formed with a larger thickness than the thickness of the vibrating film for example, and sound holes are provided for the transmission of sound waves to the vibrating film.

In terms of sensitivity to sound pressure in the above-described acoustic transducer, according to one or more embodiments of the present invention, a sensitivity to sound pressure in the first sensing portion is higher than a sensitivity to sound pressure in the second sensing portion. If the sensitivity to sound pressure in the first sensing portion is higher in this way, sound waves having a comparatively low sound pressure can be detected favorably, but distortion increases with sound waves having a comparatively high sound pressure. As a result, the first sensing portion can be favorably used in the detection of sound waves having a relatively low sound pressure. Also, the second detection portion in which the sensitivity is lower than the first sensing portion can perform detection with reduced distortion even in the case of sound waves having a relatively high sound pressure. However, since the sensitivity to sound pressure is lower in the second detection portion, it is difficult to detect sound waves having a comparatively low sound pressure, and in view of this, the second sensing portion can be favorably used to detect sound waves having a relatively high sound pressure. In this way, at least the first sensing portion and the second sensing portion having different sensitivities to sound pressure are provided in the acoustic transducer, thus achieving so-called multi-channel characteristics and widening the dynamic range of the acoustic transducer.

In the first sensing portion and the second sensing portion, the fixed film is used in common between the sensing portions, the one vibrating electrode is divided into the first sensing region and the second sensing region that respectively correspond to the two sensing portions, and the fixed electrode also has configurations corresponding to the first sensing region and the second sensing region. This enables suppressing mismatching in terms of acoustic characteristics such as the phase and the frequency characteristics between the sensing portions. Note that the sensing regions in one or more embodiments of the present invention are configurations that are demarcated regions into which the vibrating electrode is divided, and respectively correspond to portions of the vibrating electrode. Accordingly, it can be said that the sensing regions are included in the vibrating electrode, and that part or all of the vibrating electrode is formed by these regions.

In the acoustic transducer configured as described above, in the first sensing portion having a relatively high sensitivity, a floating type of fixing technique is applied in which when voltage is applied between the fixed electrode and the vibrating electrode, the first sensing region in the vibrating electrode becomes relatively fixed to the fixed film by the resulting electrical attraction, whereas when the voltage application is canceled, the first sensing region in the vibrating electrode becomes free. Note that the first predetermined gap that is the gap between the fixed electrode and the first sensing region in the vibrating electrode during voltage application can be appropriately set in consideration of the sensitivity to sound pressure in the first sensing portion, as well as the acoustic characteristics, power consumption during voltage application, and the like. If a floating type of fixing technique is applied in this way, it is possible to suppress the influence of internal stress in the vibrating film during sound wave detection, and to improve the acoustic characteristics of the first sensing portion.

On the other hand, in the acoustic transducer, in the second sensing portion having a relatively low sensitivity, since the sensitivity is set lower than in the first sensing portion, a technique different from the floating type fixing technique used in the first sensing portion is used, that is to say, the vibrating film in the second sensing region is fixed by being fixed to the substrate or the fixed film. Here, the second predetermined gap that is the gap between the fixed electrode and the second sensing region in the vibrating electrode can be appropriately set in consideration of the sensitivity to sound pressure in the second sensing portion, as well as the acoustic characteristics, power consumption during voltage application, productivity in wafer processing, and the like.

In this way, a technique different from the floating type in the first sensing portion is used in the second sensing portion because Applicant found that in the second sensing portion in which the sensitivity is lowered in order to enable detection of sound waves having a high sound pressure in order to widen the dynamic range, if the floating type of fixing technique for fixing the vibrating electrode by electrical attraction is used, the vibrating electrode becomes misaligned or separated due to sound pressure, and it is difficult to form a stable capacitance environment for sound wave detection. Specifically, the sound waves that are to be detected in the second sensing portion are envisioned to have a comparatively high sound pressure, and if merely electrical attraction is used, there is the risk of the vibrating electrode becoming misaligned or separated from the fixed film due to the sound pressure, and generating distortion in the sound wave detection signal. In order to raise the electrical attraction between the electrodes and obtain the ability to withstand high sound pressure, it is possible to raise the voltage applied between the vibrating electrode and the fixed electrode, or to reduce the distance between the electrodes. However, if these techniques are applied, distortion occurs in the signals in the amplifiers in the electrical circuit in later-stage processing, and therefore it is not possible to improve the AOP. Furthermore, the technique of raising the voltage applied between the electrodes has the disadvantages of a rise in the chip area of the electrical circuit for supplying a voltage and a rise in current consumption, and the technique of reducing the distance between the electrodes has disadvantages such as that a reduction in the distance makes it more likely to be influenced by production variations in chip creation. In view of this, it is thought to be difficult to raise the AOP with the floating type of technique.

With the acoustic transducer configuration as described above, the floating type of fixing technique is applied to the vibrating electrode in the first sensing portion that has a high sensitivity in order to obtain favorable acoustic characteristics, whereas in the second sensing portion that has a lowered sensitivity in order to similarly raise the AOP, a different technique from the floating type is used, that is to say the vibrating film in the second sensing region is directly fixed to the substrate or the fixed film. As a result, it is possible to take maximum advantage of the benefits of the floating type of fixing technique, while also achieving an AOP increase in the acoustic transducer.

Note that in the acoustic transducer, in the first sensing portion, when a voltage is applied between the fixed electrode and the vibrating electrode, the protrusion portion provided on the fixed film and the vibrating film come into contact, and thus the first sensing region is fixed to the fixed film in a state in which an air gap that is a first predetermined gap is formed. In this way, using the protrusion portion makes it possible to more accurately form the first predetermined gap during sound wave detection, thus making it possible to improve the acoustic characteristics in the first sensing portion in which the floating type of fixing technique is used. Note that the protrusion portion may be formed as multiple structures on the fixed film, and in this case, it is sufficient that the positions of the structures and intervals therebetween are appropriately set based on the internal stress remaining due to the structures, the extent to which the structures influence the acoustic characteristics, and the like.

Also, in the above-described acoustic transducer, in the second sensing portion, regardless of voltage application between the fixed electrode and the vibrating electrode, the vibrating film in the second sensing region may be fixed in a state of being constantly joined to the substrate or the fixed film in a state in which the air gap that is the second predetermined gap is formed. In other words, in the second sensing portion, if the second sensing region of the vibrating electrode is fixed in the state of being joined to the substrate or the fixed film regardless of whether or not power is being supplied for sound wave detection, the relative structural relationship between the two is specified, and the second sensing region is positioned relative to the fixed film. As a result, the sensitivity to sound pressure in the second electrode is easier to set lower than the first electrode.

Here, in the above-described acoustic transducer, the first sensing region and the second sensing region may be divided by a slit provided in the vibrating electrode in a state in which the first sensing region and the second sensing region are connected via a connection portion, and the slit may enable the first sensing region to approach the fixed film due to voltage application between the fixed electrode and the vibrating electrode. Forming the slit in this way makes it possible for the vibrating electrode itself, which is formed as a single structure, to be divided into two regions while leaving the connection portion. As a result, it is possible to achieve both displacement and fixing of the first sensing region by voltage application in the first sensing portion and fixing of the second sensing region in the second sensing portion, while suppressing mismatching in terms of the acoustic characteristics between the sensing portions. Note that in the case of this configuration, the first sensing region and the second sensing region may be electrically short-circuited. If the first sensing region and the second sensing region are electrically connected by the connection portion, among the connection terminals of the first sensing portion and the second sensing portion, the connection terminals on the vibrating electrode side can be used in common, and it is possible to simplify the electrical configuration of the acoustic transducer.

According to one or more embodiments of the present invention, in place of the vibrating electrode being divided by the slit, the vibrating electrode may be formed such that the first sensing region and the second sensing region of the vibrating electrode are divided by an isolation groove space formed therebetween so as to be independent of each other, and the first sensing region may be configured to approach the fixed film independently of the second sensing region when voltage is applied between the fixed electrode and the vibrating electrode. If the first sensing region and the second sensing region are divided so as to be independent of each other with the isolation groove space therebetween in this way, it is easier to adjust the sensitivity to sound pressure in the sensing portions, and it is easier to shape and arrange the vibrating electrode regions in the sensing portions.

According to one or more embodiments of the present invention, in the case in which the vibrating electrode is divided, an in-opening substrate portion that is a portion of the substrate may be arranged at a position that is inside the opening portion and opposes the isolation groove space, and so as to cover the isolation groove space. According to this configuration, the in-opening substrate portion serves to raise the acoustic resistance in the sensing portions, and in particular, it is possible to suppress a drop in the low-frequency characteristics in the sensing portions. Accordingly, it is sufficient to arrange the in-opening substrate portion so as to cover the isolation groove space to an extent that obtains an acoustic resistance necessary for realizing the suppression of a drop in preferred low-frequency characteristics and, according to one or more embodiments of the present invention, the in-opening substrate portion is arranged so as to enable avoiding thermal noise generated when the acoustic resistance is too high.

Note that when the in-opening substrate portion is provided, the in-opening substrate portion may be electrically short-circuited to the first sensing region and the second sensing region. If the first sensing region and the second sensing region are electrically connected via the in-opening substrate portion in this way, among the connection terminals of the first sensing portion and the second sensing portion, the connection terminals on the vibrating electrode side can be used in common, and it is possible to simplify the electrical configuration of the acoustic transducer.

In the above-described acoustic transducer, in the case where the vibrating film and the fixed film are arranged in the stated order above the opening portion, the fixed film may be fixed in a state of being constantly joined to the in-opening substrate portion via the isolation groove space that divides the vibrating electrode. If the fixed film is joined on the substrate side in this way, the fixed film is supported by the joining portion. As a result, it is possible to suppress warping and bending of the fixed film, and it is possible to realize favorable acoustic characteristics in the sensing portions.

In the above-described acoustic transducer, at least one of the first sensing region and the second sensing region may be formed so as to be circular. If the first sensing region and the second sensing region that form the vibrating electrode are shaped so as to be circular in this way, it is possible to mitigate the extent of stress concentration due to vibration, and it is possible to avoid failures therefrom as much as possible. Also, as another technique, at least one of the first sensing region and the second sensing region may be formed so as to be rectangular. According to this configuration, it is possible to efficiently arrange the regions in the plane of the vibrating film, thus making it possible to reduce the size of the acoustic transducer.

Also, in the above-described acoustic transducer, the area of the first sensing region may be larger than the area of the second sensing region. As described above, the first sensing portion set to have a relatively high sensitivity is used in order to detect sound waves having a comparatively low sound pressure. In view of this, sound waves having a low sound pressure can be favorably detected by relatively increasing the area of the first sensing region of the vibrating electrode that forms the first sensing portion.

Also, in the above-described acoustic transducer, the first predetermined gap and the second predetermined gap may have the same length. According to this configuration, in the case where the acoustic transducer is manufactured using MEMS technology, the portion of the vibrating film that corresponds to the first sensing region and the portion of the vibrating film that corresponds to the second sensing region can be created in the same process, and it is possible to reduce production variation caused by process variations.

Also, the scope of the present invention encompasses a microphone including: any of the above-described acoustic transducers; and a circuit portion that supplies power to the acoustic transducer for voltage application between the fixed electrode and the vibrating electrode, and amplifies an electrical signal that corresponds to detected sound waves from the acoustic transducer.

According to one or more embodiments of the present invention, it is possible to provide an acoustic transducer that detects sound waves using change in the capacitance between a vibrating electrode and a fixed electrode, converts the sound waves into an electrical signal, and outputs the electrical signal, and furthermore can realize favorable acoustic characteristics and as wide a dynamic range as possible in a microphone.

DETAILED DESCRIPTION

Embodiments of the present invention will be described below with reference to the drawings. In embodiments of the invention, numerous specific details are set forth in order to provide a more thorough understanding of the invention. However, it will be apparent to one of ordinary skill in the art that the invention may be practiced without these specific details. In other instances, well-known features have not been described in detail to avoid obscuring the invention. Note that the configurations in the following embodiments are illustrative, and the present invention is not intended to be limited to the configurations in these embodiments.

Embodiment 1

Figure 1A:
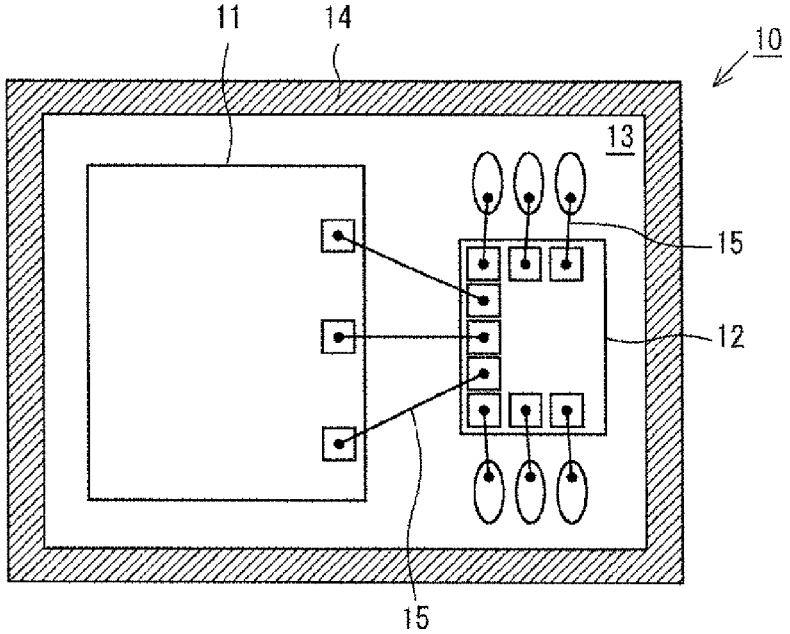
FIGS. 1A to 1C are a plan view and cross-sectional diagrams showing a schematic configuration of a microphone according to one or more embodiments of the present invention.
Figure 1B:
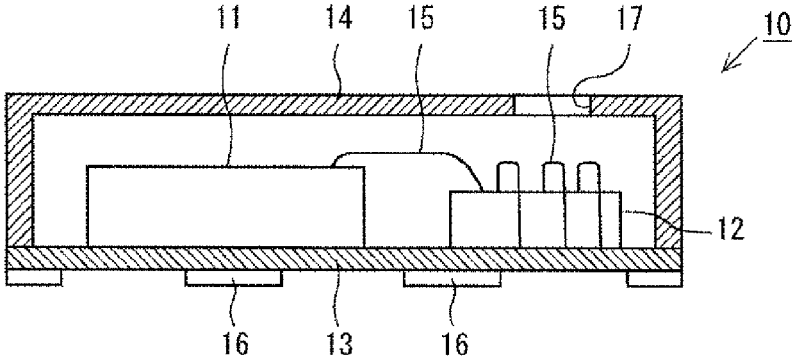

The following describes a first embodiment of the present invention with reference to FIGS. 1A to 4. FIGS. 1A to 1C show the schematic configuration of a MEMS microphone (referred to hereinafter as simply a "microphone") 10 according to one or more embodiments of the present invention. FIG. 1A is a top view of the microphone 10, and FIGS. 16 and 1C are front views of the microphone 10. Note that FIG. 1C shows a variation of FIG. 1B. Specifically, as shown in FIGS. 1A to 1C, the microphone 10 is configured so as to include the acoustic transducer 11, an ASIC 12, an interconnect substrate 13, and a casing 14. The acoustic transducer 11 is for detecting sound waves and converting them into an electrical signal (detection signal), and is a MEMS chip manufactured using MEMS technology. Details of the acoustic transducer 11 will be described later. Also, the ASIC 12 is an IC that has a power supply function of supplying power to the acoustic transducer 11 and a signal processing function of favorably processing an electrical signal from the acoustic transducer 11 and outputting it to the outside. The ASIC 12 is a semiconductor chip manufactured using semiconductor manufacturing technology. The acoustic transducer 11 and the ASIC 12 are arranged on the interconnect substrate 13 and covered by the casing 14, thus configuring the microphone 10.

Here, the electrical connection between the interconnect substrate 13, the acoustic transducer 11, and the ASIC 12 is typically made using gold wires 15, but can be made using gold bump joining or the like. Also, a connection terminal 16 for electrical connection with the outside is provided on the interconnect substrate 13. The connection terminal 16 is used when receiving a supply of power from the outside, when outputting a signal to the outside, and the Like. The interconnect substrate 13 is attached to various types of devices typically using surface reflow mounting, and is electrically connected to the devices using the connection terminal 16.

Figure 1C:
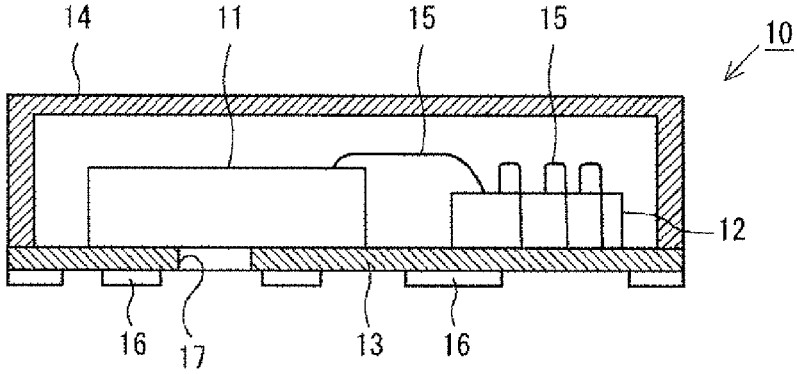

Also, the casing 14 has a function of protecting the acoustic transducer 11 and the ASIC 12 from noise from the outside, physical contact, and the like. For this purpose, the casing 14 is provided with an electromagnetic shield layer on its surface or inside. A through-hole 17 is formed in the casing 14 to allow detection-target sound waves from the outside to reach the acoustic transducer 11. Note that although the through-hole 17 is formed in the upper surface of the casing 14 (i.e., the face on the side opposite to the connection terminal 16) in FIG. 1B, it may be formed in a side face of the casing 14. Furthermore, as shown in FIG. 1C, the through-hole 17 may be provided in the interconnect substrate 13 on which the acoustic transducer 11 is arranged, at a position where it is in communication with an opening portion (back chamber) 31 of the acoustic transducer 11 that will be described later.

Figure 2A:
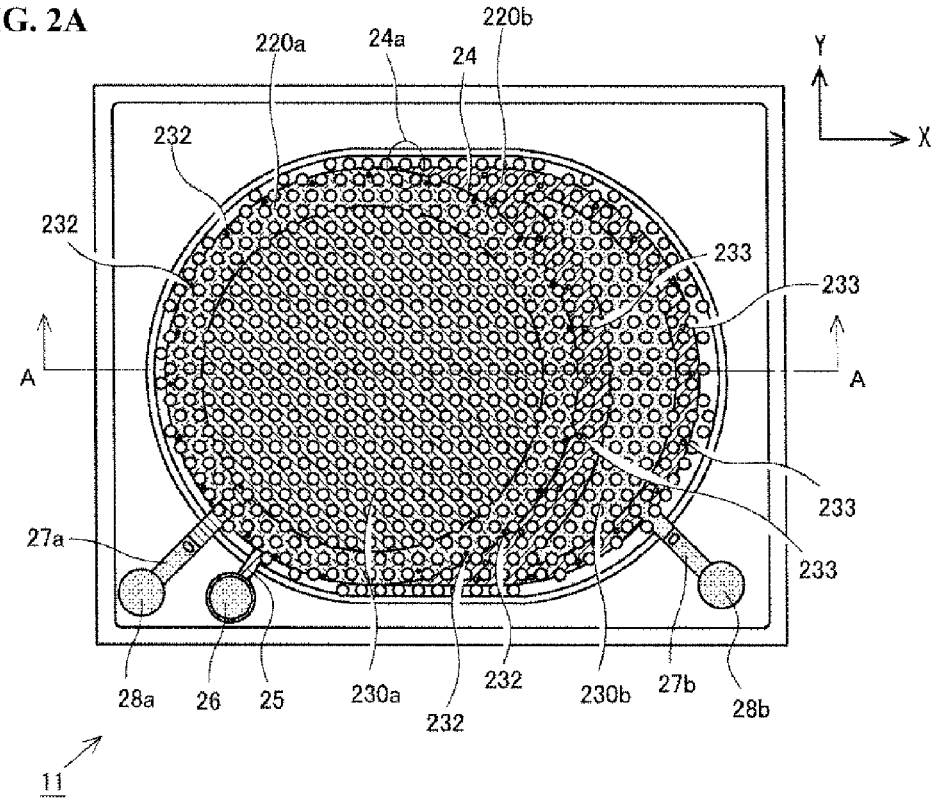
FIGS. 2A and 2B are diagrams showing a schematic configuration of an acoustic transducer according to a first embodiment of the present invention, which is installed in the microphone shown in FIGS. 1A to 1C.
Figure 2B:
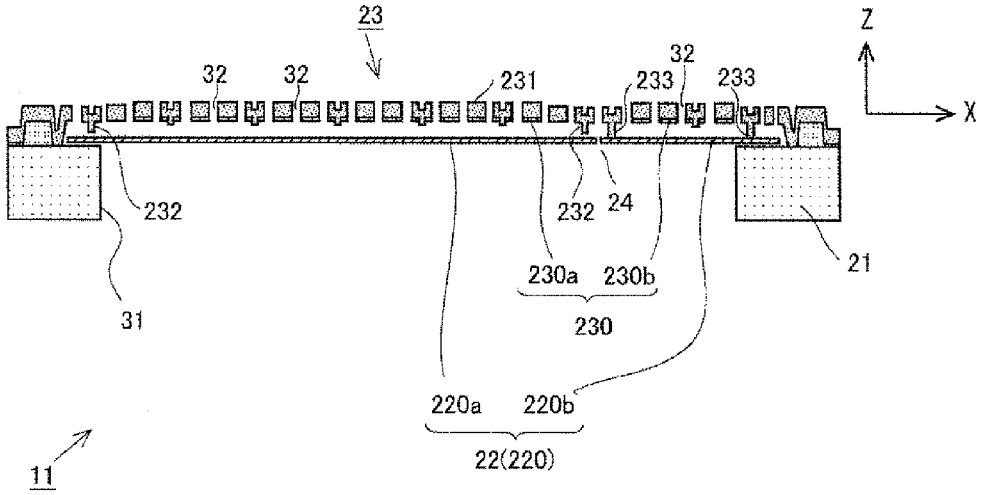

Next, FIGS. 2A and 2B show the detailed configuration of the acoustic transducer 11. Note that FIG. 2A is a plan view (XY plan view), and FIG. 2B is a ZX cross-sectional diagram taken along a line A-A in FIG. 2A and viewed in the arrow direction. As shown in FIGS. 2A and 2B, the acoustic transducer 11 mainly has a semiconductor substrate 21, a vibrating film 22 in which a vibrating electrode is formed, and a fixed film 23 in which a fixed electrode is formed. The semiconductor substrate 21 is provided with the opening portion (back chamber) 31 formed in the region that opposes the majority of the vibrating film 22, and the vibrating film 22 is arranged so as to cover the opening portion 31. Furthermore, the fixed film 23 is arranged so as to cover the vibrating film 22. The vibrating film 22 is a conductor and functions as a vibrating electrode 220, whereas the fixed film 23 is made up of a fixed electrode 230 that is a conductor and a protective film 231 that is an insulator for protecting the fixed electrode 230. The vibrating electrode 220 and the fixed electrode 230 oppose each other via an air gap and function as a capacitor when supplied with power from the ASIC 12.

Also, a large number of sound hole portions 32 are formed in the fixed film 23. Normally, the sound hole portions 32 are arranged regularly and at equal intervals, and the sound hole portions 32 have substantially the same sound hole size. Note that in the case where the microphone 10 has the configuration shown in FIG. 1B, sound waves pass through the through-hole 17 and the sound hole portions 32 in the fixed film 23, and then arrive at the vibrating film 22. Also, in the case where the microphone 10 has the configuration shown in FIG. 1C, typically the through-hole 17 and the opening portion 31 of the acoustic transducer 11 are in communication with each other, and sound waves pass through the through-hole 17 and the opening portion 31 and then arrive at the vibrating film 22. In this case, it is possible to suppress a reduction in sensitivity and frequency characteristics due to effect of the volume of the opening portion 31 in comparison with the case shown in FIG. 1B.

In the acoustic transducer 11 having the above configuration, sound waves from the outside arrive at the vibrating film 22 after passing through the sound hole portion 32 of the fixed film 23 or the opening portion 31. The vibrating film 22 then vibrates when subjected to the sound pressure from the arriving sound waves, and thus a change occurs in the gap between the vibrating electrode 220 and the fixed electrode 230, and a change occurs in the capacitance of the capacitor formed by the vibrating electrode 220 and the fixed electrode 230. By converting this change in capacitance into a change in voltage or current, the acoustic transducer 11 can detect and convert sound waves from the outside into an electrical signal (detection signal), and output the electrical signal.

Note that the acoustic transducer 11 configured as described above has many sound hole portions 32 in the fixed film 23, and the sound hole portions 32 have the following functions in addition to allowing sound waves from the outside to pass through and arrive at the vibrating film 22 as described above.

(1) Since the sound waves that arrive at the fixed film 23 have passed through the sound hole portions 32, the sound pressure applied to the fixed film 23 is reduced.

(2) Since air between the vibrating film 22 and the fixed film 23 enters and exits via the sound hole portions 32, thermal noise (fluctuation in air) is reduced. Also, since damping of the vibrating film 22 by air is reduced, degradation in high frequency characteristics due to this damping is reduced.

(3) In the case where the air gap between the vibrating electrode 220 and the fixed electrode 230 is formed using surface micromachining technology, the sound hole portions can be used as etching holes.

The vibrating electrode 220 and the fixed electrode 230 in the acoustic transducer 11 will be described below in detail. First, the vibrating electrode 220 is formed by using a slit 24 to divide the one vibrating film 22 into a first sensing region 220*a* and a second sensing region 220*b*. Here, the slit 24 is formed in the vibrating film 22, and one end of the slit 24 does not reach the outer periphery of the vibrating film 22. The first sensing region 220*a* and the second sensing region 220*b* in the vibrating electrode 220 are therefore connected by a connection portion 24*a* in the vicinity of the one end of the slit 24, and thus the first sensing region 220*a* and the second sensing region 220*b* are also in a state of being electrically connected to each other. Note that the sensing regions 220*a* and 220*b* in the first embodiment are configurations that are demarcated regions into which the vibrating electrode 220 is divided, and respectively correspond to portions of the vibrating electrode 220.

Next, the fixed electrode 230 is fixed by being joined to the semiconductor substrate 21 via the protective film 231. A high sensitivity side region 230*a* is provided in the fixed electrode 230 at a position that opposes the first sensing region 220*a* of the vibrating electrode 220, and a low sensitivity side region 230*b* is provided in the fixed electrode 230 at a position that opposes the second sensing region 220*b* of the vibrating electrode 220. Note that the regions 230*a* and 230*b* of the first embodiment are configurations that are demarcated regions in the fixed electrode 230, and respectively correspond to portions of the fixed electrode 230. Also, the high sensitivity side region 230*a* and the low sensitivity side region 230*b* are electrically isolated from each other. The high sensitivity side region 230*a* is connected to a connection terminal 28*a* via an interconnect 27*a*. The low sensitivity side region 230*b* is connected to a connection terminal 28*b* via an interconnect 27*b*. Note that since the first sensing region 220*a* and the second sensing region 220*b* of the vibrating electrode 220 are in a state of being electrically connected to each other as described above, the vibrating electrode 220 overall is connected to one connection terminal 26 via an interconnect 25.

According to this configuration, the capacitor made up of the vibrating electrode 220 and the fixed electrode 230 is divided into a high-sensitivity capacitor (corresponding to a first sensing portion of one or more embodiments of the present invention) that functions with the first sensing region 220*a* and the high sensitivity side region 230*a*, and a low-sensitivity capacitor (corresponding to a second sensing portion of one or more embodiments of the present invention) that functions with the second sensing region 220*b* and the low sensitivity side region 230*b*. As a result, the acoustic transducer 11 is configured so as to be able to convert sound waves from the outside into an electrical signal from the high-sensitivity capacitor and an electrical signal from the low-sensitivity capacitor, and output the two electrical signals.

The following describes a technique for fixing corresponding regions of the vibrating electrode 220 to the fixed film 23 in the high-sensitivity capacitor and the low-sensitivity capacitor. The high-sensitivity capacitor is formed by the first sensing region 220*a* and the high sensitivity side region 230*a*. The first sensing region 220*a* and the high sensitivity side region 230*a* are formed so as to be roughly circular, and as shown in FIG. 2B, the first sensing region 220*a* is formed so as to be larger than the high sensitivity side region 230*a*. Here, the first sensing region 220*a* is not fixed to the semiconductor substrate 21, and when power is supplied to the vibrating electrode 220 and the fixed electrode 230 in order to detect sound waves from the outside, that is to say when a voltage is applied between the two electrodes, the first sensing region 220*a* of the vibrating electrode 220 is drawn to the high sensitivity side region 230*a* side of the fixed electrode 230 by the electrical attraction (electrostatic force) acting between the two electrodes. Protrusion portions 232 that protrude from the protective film 231 toward the vibrating electrode 220 in the periphery of the high sensitivity side region 230*a* of the fixed electrode 230 are formed on the fixed film 23, and when electrical attraction acts between the electrodes due to the application of a voltage, the first sensing region 220*a* becomes displaced, and its peripheral edge region comes into contact with the protrusion portions 232 and is held there (the protrusion portions 232 correspond to contact portions of one or more embodiments of the present invention). These protrusion portions 232 protrude toward the vibrating electrode 220 beyond the high sensitivity side region 230*a* of the fixed electrode 230, and therefore the protruding height of the protrusion portions 232 is the electrode gap of the high-sensitivity capacitor.

Note that the first sensing region 220*a* is connected to the second sensing region 220*b* via the connection portion 24*a* as described above, and the connection portion 24*a* is formed with a shape and size according to which the second sensing region 220*b* does not hinder displacement of the first sensing region 220*a* toward the protrusion portions 232. Also, when the application of a voltage between the vibrating electrode 220 and the fixed electrode 230 is canceled, the electrical attraction weakens, and the state of contact between the first sensing region 220*a* and the protrusion portions 232 is also canceled. In this way, in the high-sensitivity capacitor, using the so-called floating type of fixing technique, the first sensing region 220*a* is relatively fixed to the fixed film 23 in a state in which a predetermined electrode gap necessary for capacitor formation is maintained. If a floating type of fixing technique is applied in this way, it is possible to mitigate the influence of internal stress during sound wave detection, and thus possible to improve the acoustic characteristics in sound wave detection.

On the other hand, the low-sensitivity capacitor is formed by the second sensing region 220*b* and the low sensitivity side region 230*b*. The second sensing region 220*b* and the low sensitivity side region 230*b* are formed so as to be roughly crescent-shaped such that the region width decreases as the Y-direction end portions extend as shown in FIG. 2A, and the second sensing region 220*b* is formed so as to be larger than the low sensitivity side region 230*b* as shown in FIG. 2B. Also, the second sensing region 220*b* is formed so as to be smaller than the first sensing region 220*a*. Support portions 233 that protrude from the protective film 231 toward the vibrating electrode 220 in the periphery of the low sensitivity side region 230*b* of the fixed electrode 230 are formed on the fixed film 23, and using MEMS technology, the second sensing region 220*b* is formed so as to be joined to the support portions 233. Accordingly, even if a voltage is applied in order to detect sound waves, the second sensing region 220*b* does not become displaced toward the fixed film 23 as the first sensing region 220*a* does. Note that the protruding height of the support portions 233 toward the vibrating electrode 220 is the electrode gap of the low-sensitivity capacitor. In this way, in the low-sensitivity capacitor, using a technique different from the floating type of fixing technique in the high-sensitivity capacitor, the second sensing region 220*b* is relatively fixed to the fixed film 23 in a state in which a predetermined electrode gap necessary for capacitor formation is maintained.

In summary, in the high-sensitivity capacitor, the first sensing region 220*a* is fixed to the fixed film 23 via the protrusion portions 232 by electrical attraction, whereas in the low-sensitivity capacitor, the second sensing region 220*b* is structurally fixed to the fixed film 23 via the support portions 233. In the latter fixing technique, the second sensing region 220*b* and the support portions 233 are placed in a constantly joined state using MEMS technology, and since the second sensing region 220*b* is formed so as to be smaller than the first sensing region 220*a*, the vibrational displacement of the second sensing region 220*b* in the low-sensitivity capacitor is smaller than the vibrational displacement of the first sensing region 220*a* in the high-sensitivity capacitor. Also, the space between adjacent support portions 233 in the low-sensitivity capacitor and the space between adjacent protrusion portions 232 in the high-sensitivity capacitor are appropriately adjusted. According to this configuration, the high-sensitivity capacitor is formed so as to have higher sensitivity than the low-sensitivity capacitor in terms of the sound pressure of detected sound waves.

Note that as for the manufacturing method for the acoustic transducer 11, it is obvious that a person skilled in the art could manufacture the acoustic transducer 11 using existing MEMS technology based on the disclosed configuration of the acoustic transducer 11 shown in FIGS. 2A and 2B. A detailed description of a manufacturing method will therefore not be given in this specification. Note that in the first embodiment, the semiconductor substrate 21 has a thickness of approximately 400 μm, and is a semiconductor formed from single crystal silicon or the like. The vibrating film 22 has a thickness of approximately 0.7 μm, is a conductor formed from polycrystalline silicon or the like, and functions as the vibrating electrode 220. The fixed film 23 is made up of the fixed electrode 230 and the protective film 231. The fixed electrode 230 has a thickness of approximately 0.5 μm and is a conductor formed from polycrystalline silicon or the like. On the other hand, the protective film 231 has a thickness of approximately 2 μm and is an insulator formed from silicon nitride or the like. Also, the gap between the vibrating electrode 220 and the fixed electrode 230 is appropriately set in consideration of the sound pressure sensitivities of the high-sensitivity capacitor and the low-sensitivity capacitor and the like. Note that if the electrode gap in the high-sensitivity capacitor and the electrode gap in the low-sensitivity capacitor are set to the same length, the vibrating film-side (vibrating electrode-side) portions that correspond to the respective capacitors can be created in the same process in the MEMS manufacturing process. This makes it possible to reduce production variation caused by process variations during manufacturing.

Figure 3:
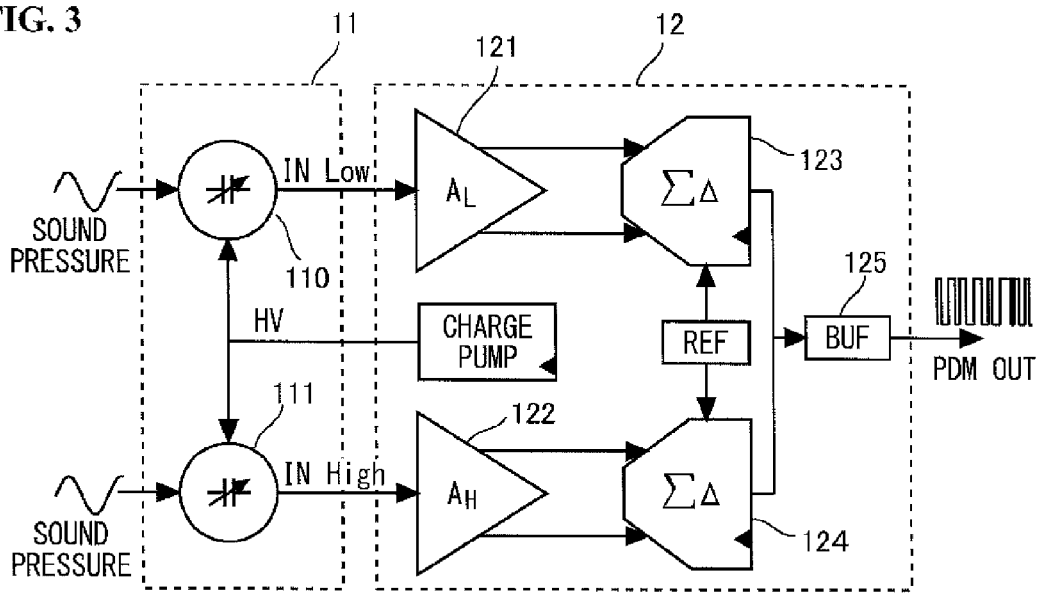
FIG. 3 is a circuit diagram of the microphone shown in FIGS. 1A to 1C.
Figure 4:
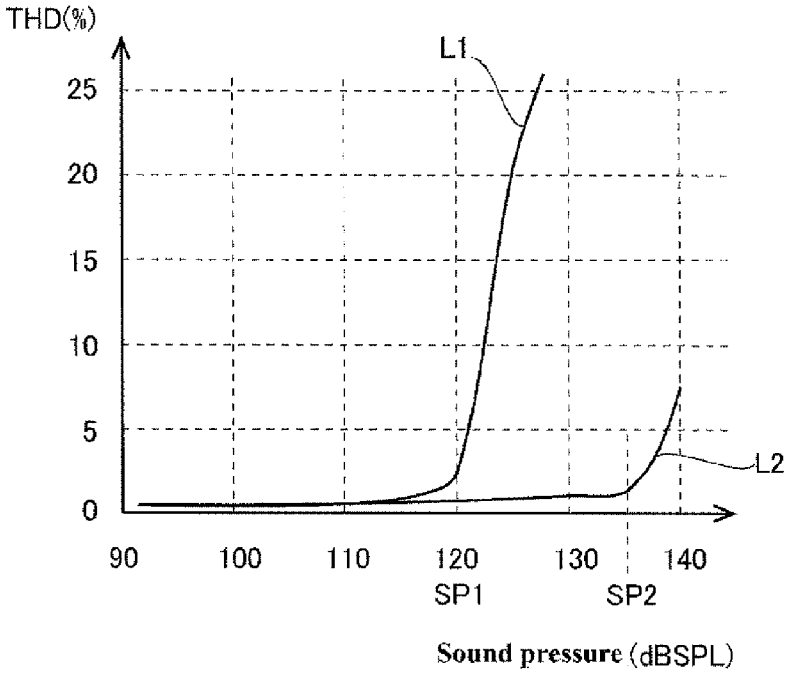
FIG. 4 is a diagram showing the correlation between the sound pressure of input sound waves and the harmonic distortion rate (THD) of a detection signal in the microphone shown in FIGS. 1A-1B.

FIG. 3 is a circuit diagram of the microphone 10. As described above, the acoustic transducer 11 is configured so as to include the low-sensitivity capacitor 110 and the high-sensitivity capacitor 111 whose capacitances change according to sound waves. Also, the ASIC 12 is configured so as to include a charge pump 120, a low-sensitivity amplifier 121, a high-sensitivity amplifier 122, ΣΔ (ΔΣ) ADCs (Analog-to-Digital Converters) 123 and 124, and a buffer 125.

When a high voltage HV from the charge pump 120 is applied between the vibrating electrode 220 and the fixed electrode 230 of the acoustic transducer 11, sound waves are converted into electrical signals by the low-sensitivity capacitor 110 and the high-sensitivity capacitor 111. The electrical signal obtained by the low-sensitivity capacitor 110 is amplified by the low-sensitivity amplifier 121 and converted into a digital signal by the ΣΔ ADC 123. Similarly, the electrical signal obtained by the high-sensitivity variable capacitor 111 is amplified by the high-sensitivity amplifier 122 and converted into a digital signal by the ΣΔ ADC 124. The digital signals obtained by the ΣΔ ADCs 123 and 124 are output to the outside as PDM (Pulse Density Modulation) signals via the buffer 125. Also, in the example in FIG. 3, the two digital signals obtained by the ΣΔ ADCs 123 and 124 are consolidated and output over one data line, but the two digital signals may be output over separate data lines.

Note that although the fixed electrode 230 is electrically divided into the high sensitivity side region 230*a* and the low sensitivity side region 230*b* in the first embodiment, the vibrating electrode 220 is electrically unified. As a result, compared to the case where the fixed electrode 230 and the vibrating electrode 220 are both divided, there are fewer connections between the ASIC 12 and the acoustic transducer 11, thus improving the productivity of the microphone 10. Also, since there are fewer connection terminals for connection with the ASIC 12, it is possible to improve the acoustic characteristics by reducing the parasitic capacitance attributed to the connection terminals. Also, since only one voltage needs to be applied from the charge pump 120, the size of the ASIC 12 including the charge pump 120 can be reduced, the manufacturing cost can be lowered, and variations in detection sensitivity due to variations in the creation of the charge pump 120 can be suppressed.

In the acoustic transducer 11 configured in this way, and in the microphone 10 including this acoustic transducer, sound waves from the outside can be converted into two electrical signals by the high-sensitivity capacitor and the low-sensitivity capacitor having different detection sensitivities, and the electrical signals can be output. For example, in FIG. 4, a line L1 indicates the correlation between the sound pressure and the harmonic distortion rate in the high-sensitivity capacitor, and a line L2 indicates the correlation between the sound pressure and the harmonic distortion rate in the low-sensitivity capacitor. According to this figure, the high-sensitivity capacitor favorably detects sound waves with a relatively low sound pressure (e.g., detects sound waves with a sound pressure lower than SP1 (e.g., 120 dBSPL)), and the low-sensitivity capacitor detects sound waves with a relatively high sound pressure (e.g., detects sound waves with a sound pressure greater than or equal to SP1 and lower than SP2 (e.g., 135 dBSPL)), and therefore it can be understood that it is possible to widen the dynamic range of detectable sound pressures compared to a conventional acoustic sensor that includes only one variable capacitor. Furthermore, the first sensing region 220*a* is formed so as to have a larger area than the second sensing region 220*b*, and therefore the high-sensitivity capacitor can detect sound waves with a lower sound pressure.

Also, by using a floating type of fixing technique as the technique for fixing the vibrating electrode 220 to the fixed film 23 as described above, it is possible to reduce the influence of stress inside the vibrating electrode 220, and this method is favorable to an improvement in acoustic characteristics. However, in the first embodiment, this fixing technique is applied to only the high-sensitivity capacitor, and is not applied to the low-sensitivity capacitor. This is in consideration of the fact that the low-sensitivity capacitor is a configuration for detecting sound waves with a relatively high sound pressure, and if the floating type of fixing technique is applied, there is the possibility of degradation in the acoustic characteristics caused by misalignment of the vibrating electrode 220 due to the sound pressure. Accordingly, a fixing technique for achieving constant joining to the fixed film 23 is applied to the low-sensitivity capacitor. Accordingly, the acoustic transducer 11 can have more favorable acoustic characteristics as a whole.

Also, although the fixed electrode 230 is divided into the high sensitivity side region 230*a* and the low sensitivity side region 230*b* in the first embodiment, the fixed film 23 is used in common via the protective film 231. Accordingly, in the acoustic transducer 11 of the first embodiment, it is possible to suppress mismatching in terms of the acoustic characteristics such as the phase and the frequency characteristics of the high-sensitivity capacitor and the low-sensitivity capacitor. Furthermore, since the vibrating electrode 220 and the fixed electrode 230 are each formed so as to have a uniform thickness, mismatching in terms of the acoustic characteristics can be more effectively suppressed.

Embodiment 2

Figure 5A:
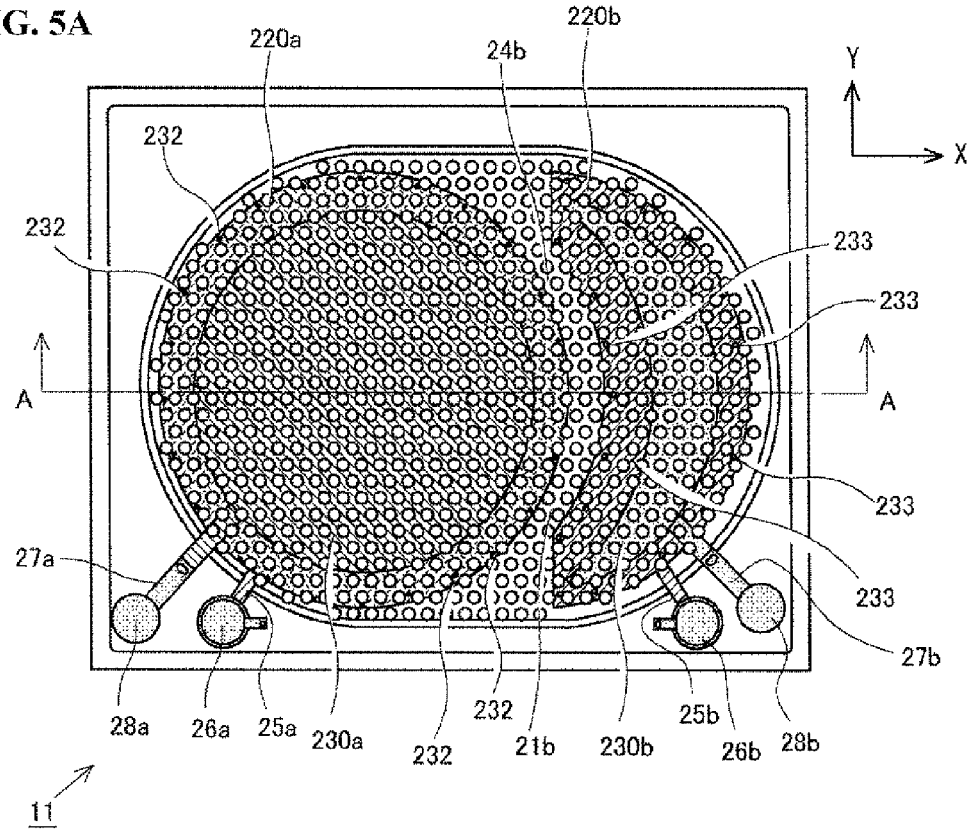
FIGS. 5A and 5B are diagrams showing a schematic configuration of an acoustic transducer according to a second embodiment of the present invention, which is installed in the microphone shown in FIGS. 1A to 1C.
Figure 5B:
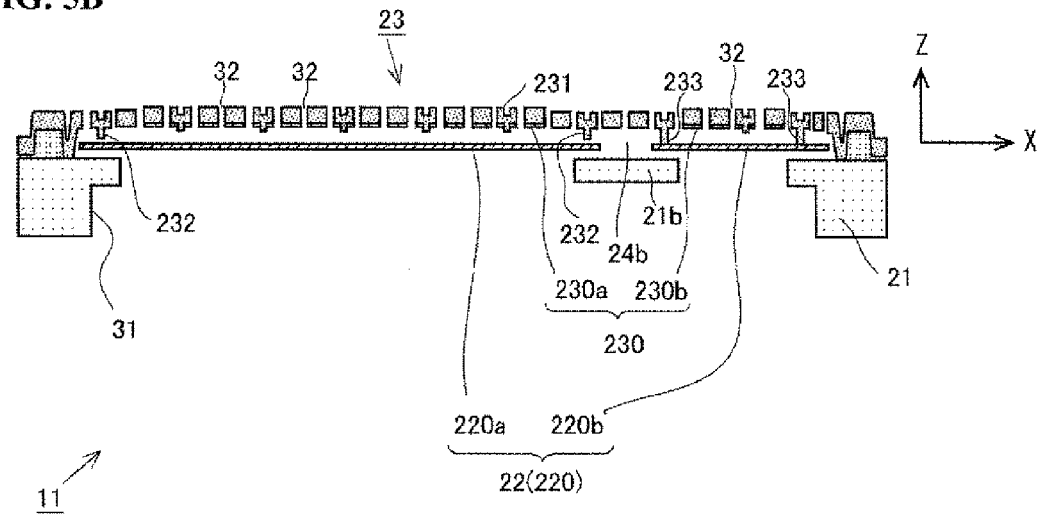

FIGS. 5A and 5B show the schematic configuration of an acoustic transducer 11 according to a second embodiment of the present invention. Note that FIG. 5A is a plan view (XY plan view), and FIG. 5B is a ZX cross-sectional diagram taken along a line A-A in FIG. 5A and viewed in the arrow direction. The acoustic transducer 11 of the second embodiment is different from the acoustic transducer of the first embodiment with respect to the configuration of the vibrating electrode 220 of the vibrating film 22 and the related configurations, and the other configurations are substantially the same. In view of this, the same reference numbers will be used for configurations that are the same, and detailed descriptions will not be given for them.

In the acoustic transducer 11 of the second embodiment, the first sensing region 220*a* and the second sensing region 220*b* of the vibrating electrode 220 are completely isolated by a space occupied by an isolation groove 24*b*. Specifically, in the first embodiment, the first sensing region 220*a* and the second sensing region 220*b* of the vibrating electrode 220 are separated by the slit 24 but connected by the connection portion 24*a*, but in the second embodiment, these two regions are completely isolated by the isolation groove 24*b*. Note that the configurations of the fixed film 23 and the fixed electrode 230 are similar to the configurations in the first embodiment. Accordingly, the first sensing region 220*a* is connected to the connection terminal 26*a* via the interconnect 25*a*, and the second sensing region 220*b* is connected to the connection terminal 26*b* via the interconnect 25*b*. Also, the high sensitivity side region 230*a* is connected to the connection terminal 28*a* via the interconnect 27*a*, and the low sensitivity side region 230*b* is connected to the connection terminal 28*b* via the interconnect 27*b*. As a result, in the acoustic transducer 11 of the second embodiment, two connection terminals are provided on the vibrating electrode 220 side, and two connection terminals are provided on the fixed electrode 230 side.

When the first sensing region 220*a* and the second sensing region 220*b* of the vibrating electrode 220 are completely isolated in this way, it is easier to adjust the arrangement, sound pressure sensitivity, and the like of the high-sensitivity capacitor formed by the first sensing region 220*a* and the high sensitivity side region 230*a*, and the low-sensitivity capacitor formed by the second sensing region 220*b* and the low sensitivity side region 230*b*. Note that in the high-sensitivity capacitor, the first sensing region 220*a* is fixed to the fixed film 23 using a floating type of fixing technique similarly to the first embodiment, and in the low-sensitivity capacitor, the second sensing region 220*b* is fixed to the support portion 233 so as to be joined thereto similarly to the first embodiment. Also, since the first sensing region 220*a* is completely independent from the second sensing region 220*b*, the first sensing region 220*a* is not influenced by any sort of external force from the second sensing region 220*b* during voltage application. As a result, the displacement of the first sensing region 220*a* toward the fixed film 23 during voltage application is performed smoothly, and thus the acoustic characteristics of the high-sensitivity capacitor can be made more favorable.

On the other hand, due to the presence of the isolation groove 24, air in the space between the vibrating electrode 220 and the fixed electrode 230 easily leaks out, and there is a tendency for a reduction in the roll-off frequency and a reduction in the low-frequency acoustic characteristics of the high-sensitivity capacitor and the low-sensitivity capacitor. In view of this, as shown in FIG. 5B, an in-opening substrate portion 21*b* is arranged in the opening portion 31 below the isolation groove 24 so as to cover the isolation groove 24. As shown in FIG. 5A, the isolation groove 24*b* extends in the Y direction, and the in-opening substrate portion 21*b* extends along the isolation groove 24*b* in the same Y direction. The presence of the in-opening substrate portion 21*b* forms a portion where the vibrating electrode 220 and the in-opening substrate portion 21*b* are overlapped in XY direction, thus making it possible to raise the acoustic resistance of the high-sensitivity capacitor and the low-sensitivity capacitor, which makes it possible to improve the low-frequency acoustic characteristics. Also, the width of the isolation groove 24 can be increased since the acoustic resistance can be maintained by the overlap portion, and this has advantages such as making it possible to reduce production variation caused by variation in the width dimension, and to shape the isolation groove 24 with a non-constant groove width, such as the case where the boundary line shape of the first sensing region 220*a* on the second sensing region 220*b* side is not the same as the boundary line shape of the second sensing region 220*b*. Also, the provision of the in-opening substrate portion 21*b* enables increasing the strength of the semiconductor substrate 21. Note that by covering the isolation groove 24 with the in-opening substrate portion 21*b*, thermal noise is more likely to have an influence in the capacitors. In view of this, it is sufficient for the extent to which the in-opening substrate portion 21*b* covers the isolation groove 24 to be adjusted with a range of permissible thermal noise.

Variation

In one or more the above embodiments, the first sensing region 220*a* and the second sensing region 220*b* of the vibrating electrode 220 are isolated electrically as well, and therefore two connection terminals are provided on the vibrating electrode 220 side likewise to the fixed electrode 230 side. In view of this, the first sensing region 220*a* and the second sensing region 220*b* that are isolated by the isolation groove 24 may be electrically connected via the in-opening substrate portion 21*b*. This configuration enables reducing the number of connection terminals on the vibrating electrode 220 side to one likewise to the first embodiment.

Embodiment 3

Figure 6A:
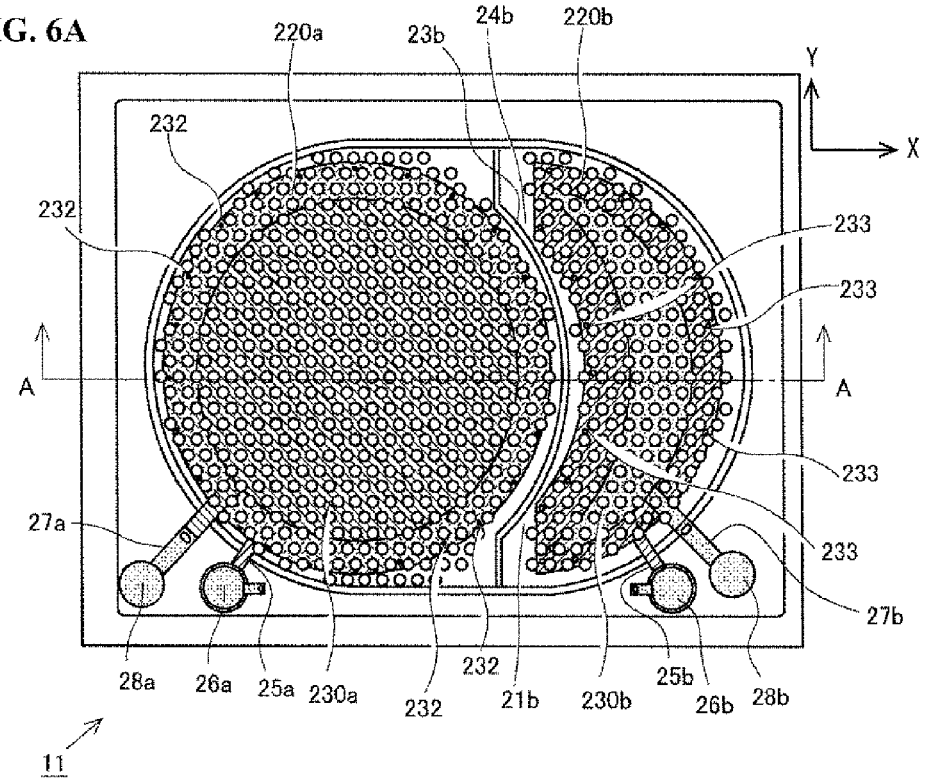
FIGS. 6A and 6B are diagrams showing a schematic configuration of an acoustic transducer according to a third embodiment of the present invention, which is installed in the microphone shown in FIGS. 1A to 1C.
Figure 6B:
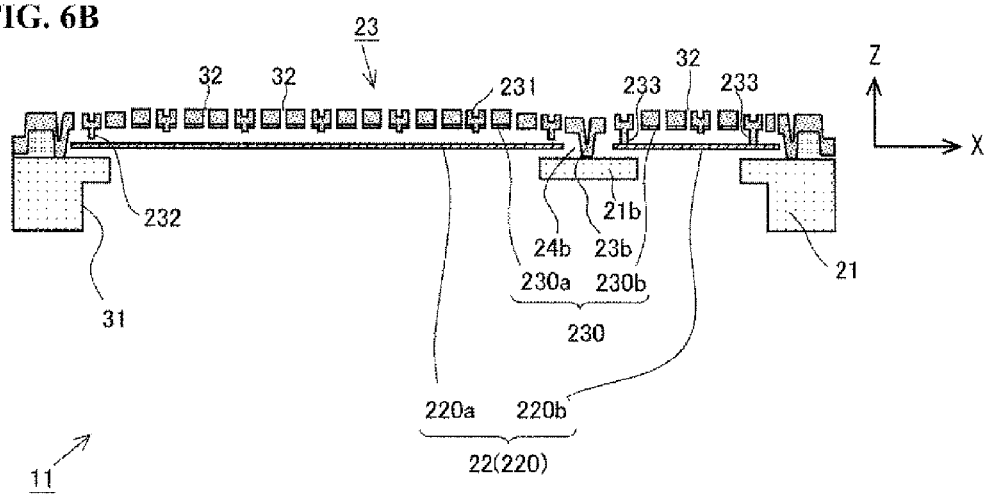

FIGS. 6A and 6B show the schematic configuration of an acoustic transducer 11 according to a third embodiment of the present invention. Note that FIG. 6A is a plan view (XY plan view), and FIG. 6B is a ZX cross-sectional diagram taken along a line A-A in FIG. 6A and viewed in the arrow direction. In the acoustic transducer 11 of the third embodiment, the first sensing region 220*a* and the second sensing region 220*b* of the vibrating electrode 220 are completely isolated by the space occupied by the isolation groove 24*b* likewise to the acoustic transducer of the second embodiment. However, the structural relationship between the fixed film 23 and the in-opening substrate portion 21*b* is different from the configuration in the second embodiment. In view of this, the same reference numbers will be used for configurations that are similar to those in one or more of the above embodiments, and detailed descriptions will not be given for them.

In the acoustic transducer 11 of the third embodiment, an extension portion 23*b* that extends across the space of the isolation groove 24*b* and comes into contact with the in-opening substrate portion 21*b* is formed in the region of the protective film 231, which is formed by an insulator, of the fixed film 23 that is located above the isolation groove 24*b*, and the extension portion 23*b* is joined to the in-opening substrate portion 21*b*. As shown in FIG. 6A, the extension portion 23*b* extends along the isolation groove 24*b* in the Y direction in the XY plane, and thus the fixed film 23 itself is joined to the in-opening substrate portion 21*b* via the extension portion 23*b*. According to this configuration, the fixed film 23 is supported by the extension portion 23*b*, thus making it possible to increase the rigidity of the fixed film 23 and suppress warping and bending of the fixed film 23, and also improving the productivity of the acoustic transducer 11 as well as increasing the strength of the fixed film 23.

Embodiment 4

Figure 7A:
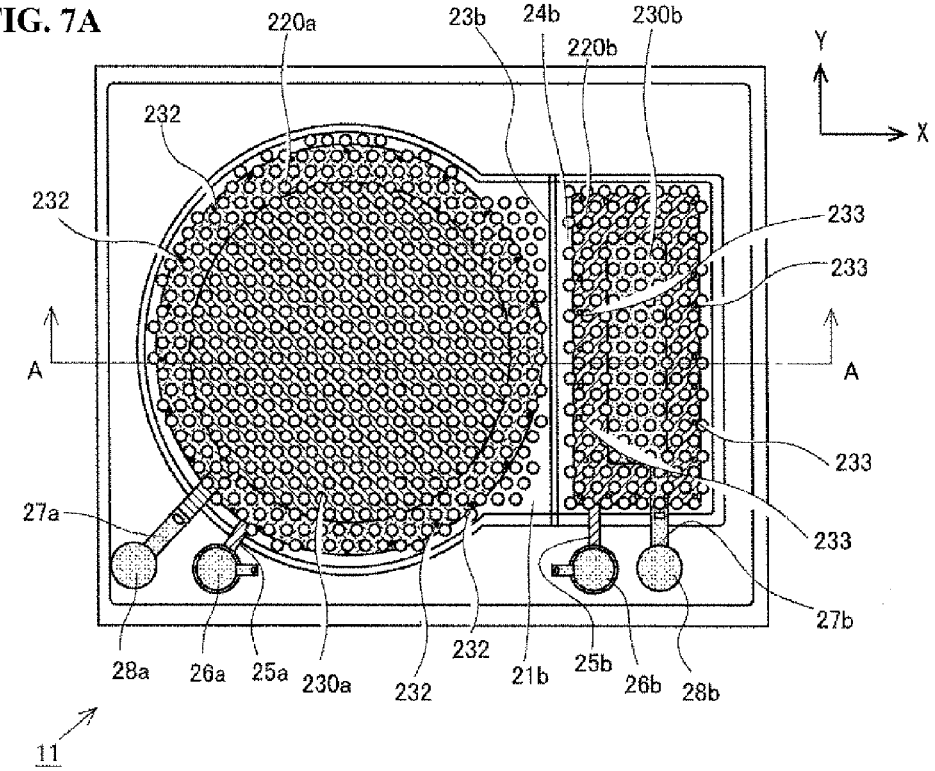
FIGS. 7A and 7B are diagrams showing a schematic configuration of an acoustic transducer according to a fourth embodiment of the present invention, which is installed in the microphone shown in FIGS. 1A to 1C.
Figure 7B:
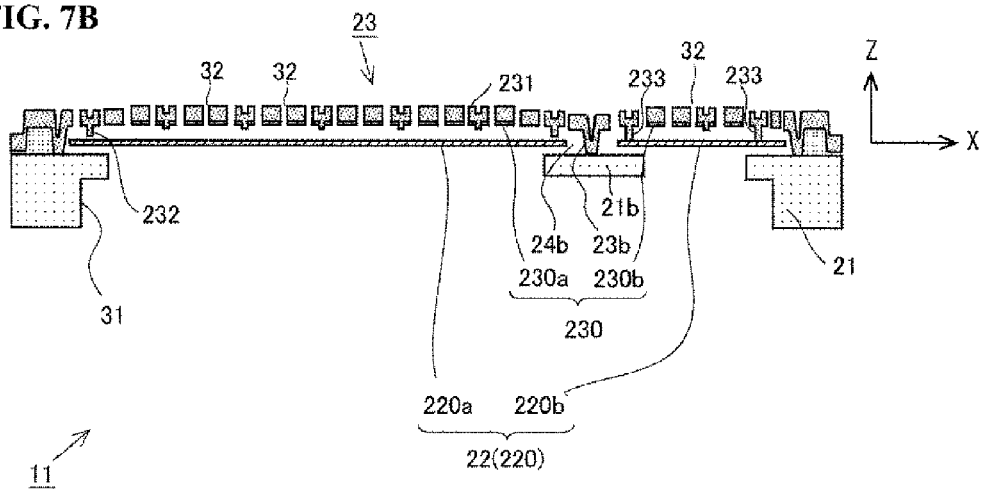

FIGS. 7A and 7B show the schematic configuration of an acoustic transducer 11 according to a fourth embodiment of the present invention. Note that FIG. 7A is a plan view (XY plan view), and FIG. 7B is a ZX cross-sectional diagram taken along a line A-A in FIG. 7A and viewed in the arrow direction. In the acoustic transducer 11 of the fourth embodiment, the first sensing region 220*a* and the second sensing region 220*b* of the vibrating electrode 220 are completely isolated by the space occupied by the isolation groove 24*b*, and the fixed film 23 is joined and supported to the in-opening substrate portion 21*b* via the extension portion 23*b*, likewise to the acoustic transducer of the third embodiment. However, the shapes of the second sensing region 220*b* of the vibrating electrode 220 and the low sensitivity side region 230*b* of the fixed electrode 230 are different from the configurations in the third embodiment. In view of this, the same reference numbers will be used for configurations that are similar to those in one or more of the above embodiments, and detailed descriptions will not be given for them.

In the acoustic transducer 11 of the fourth embodiment, the second sensing region 220*b* of the vibrating electrode 220 and the low sensitivity side region 230*b* of the fixed electrode 230 that form the low-sensitivity capacitor are formed so as to be substantially rectangular. Note that the first sensing region 220*a* of the vibrating electrode 220 and the high sensitivity side region 230*a* of the fixed electrode 230 are circular similarly to one or more of the above embodiments. By forming the regions making up the low-sensitivity capacitor so as to be rectangular in this way, it is possible to effectively ensure the electrode surfaces for detecting sound waves with a high sound pressure, and compatibility is favorable since the chip is rectangular, thus making it possible to suppress the occupied area required for formation of the acoustic transducer 11 (the area of the XY plane shown in FIG. 7A), and to reduce the size of the acoustic transducer 11.

Note that the configuration in which the regions making up the capacitor are formed so as to be rectangular in this way may be applied to the high-sensitivity capacitor. This configuration can be applied to the configurations of Embodiments 1 and 2 as well.

Embodiment 5

Figure 8A:
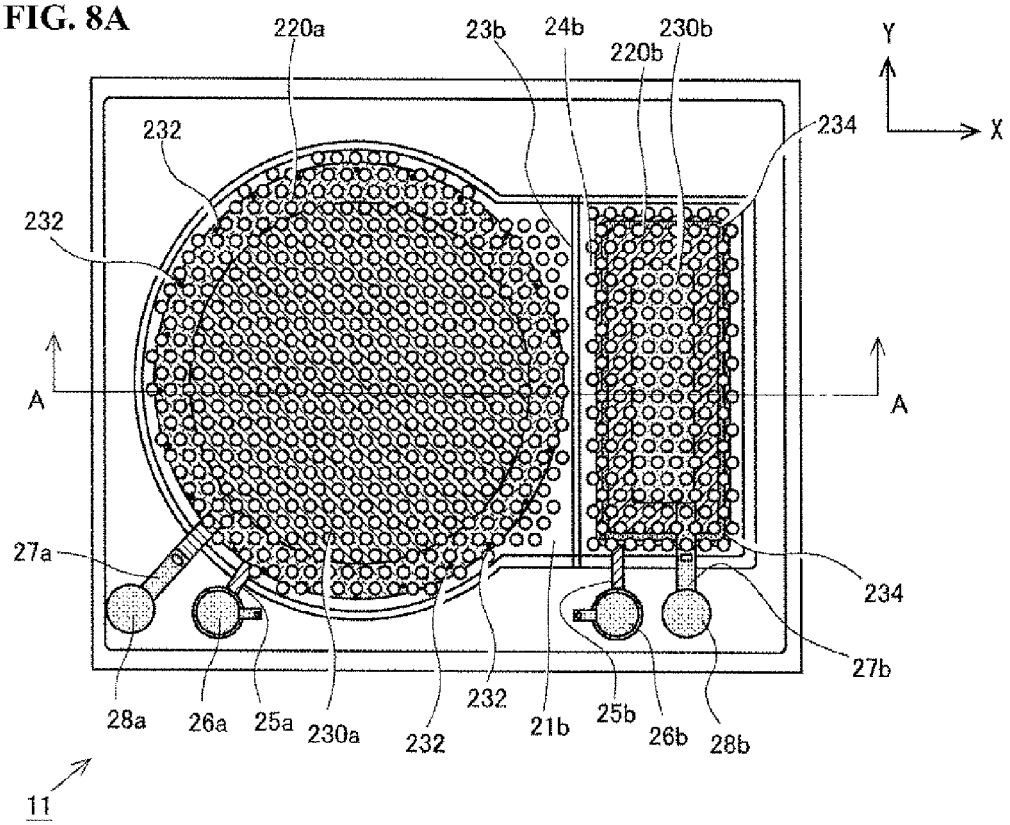
FIGS. 8A and 8B are diagrams showing a schematic configuration of an acoustic transducer according to a fifth embodiment of the present invention, which is installed in the microphone shown in FIGS. 1A to 1C.
Figure 8B:
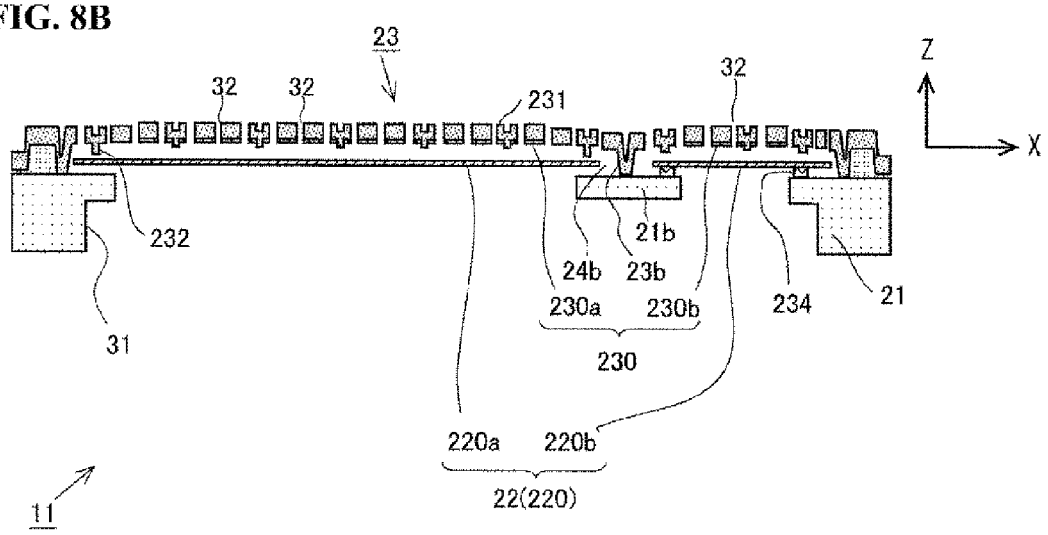

FIGS. 8A and 8B show the schematic configuration of an acoustic transducer 11 according to a fifth embodiment of the present invention. Note that FIG. 8A is a plan view (XY plan view), and FIG. 8B is a ZX cross-sectional diagram taken along a line A-A in FIG. 8A and viewed in the arrow direction. In the acoustic transducer 11 of the fifth embodiment, the first sensing region 220*a* and the second sensing region 220*b* of the vibrating electrode 220 are completely isolated by the space occupied by the isolation groove 24*b*, and the fixed film 23 is joined and supported to the in-opening substrate portion 21*b* via the extension portion 23*b*, likewise to the acoustic transducer of the fourth embodiment. Furthermore, the shapes of the second sensing region 220*b* of the vibrating electrode 220 and the low sensitivity side region 230*b* of the fixed electrode 230 are substantially rectangular. However, the technique for positioning the second sensing region 220*b* of the vibrating electrode 220 relative to the fixed film 23, that is to say the technique for forming the low-sensitivity capacitor, is different. In view of this, the same reference numbers will be used for configurations that are similar to those in one or more of the above embodiments, and detailed descriptions will not be given for them.

In the acoustic transducer 11 of the fifth embodiment, instead of the second sensing region 220*b* of the vibrating electrode 220 being fixed to the fixed film 23 via the support portions 233 as in one or more of the above-described embodiments, the second sensing region 220*b* is fixed above the semiconductor substrate 21 and the in-opening substrate portion 21*b* via a support portion 234. With this fixing technique as well, the second sensing region 220*b* can be positioned relative to the fixed film 23, and a favorable distance can be ensured as the gap between the low sensitivity side region 230*b* of the fixed electrode 230 and the second sensing region 220*b* of the vibrating electrode 220.

Also, since the support portion 234 is located on the substrate side, the low-sensitivity capacitor is not likely to be influenced by thermal noise generated by air in the overlapping portion of the second sensing region 220*b* of the vibrating electrode 220 and the in-opening substrate portion 21*b*, and therefore the support portion 234 can be formed in a continuous manner or in a ring shape on the semiconductor substrate 21 and the in-opening substrate portion 21*b*. According to this configuration, vibrational displacement of the second sensing region 220*b* is further suppressed, thus making it easier to lower the sensitivity of the low-sensitivity capacitor, which is thought to also contribute to the widening of the dynamic range of the acoustic transducer 11.

Note that the configuration in which the second sensing region 220*b* is supported on the substrate side via the support portion 234 may be applied to the configurations of Embodiments 1 and 2.

Embodiment 6

Figure 9A:
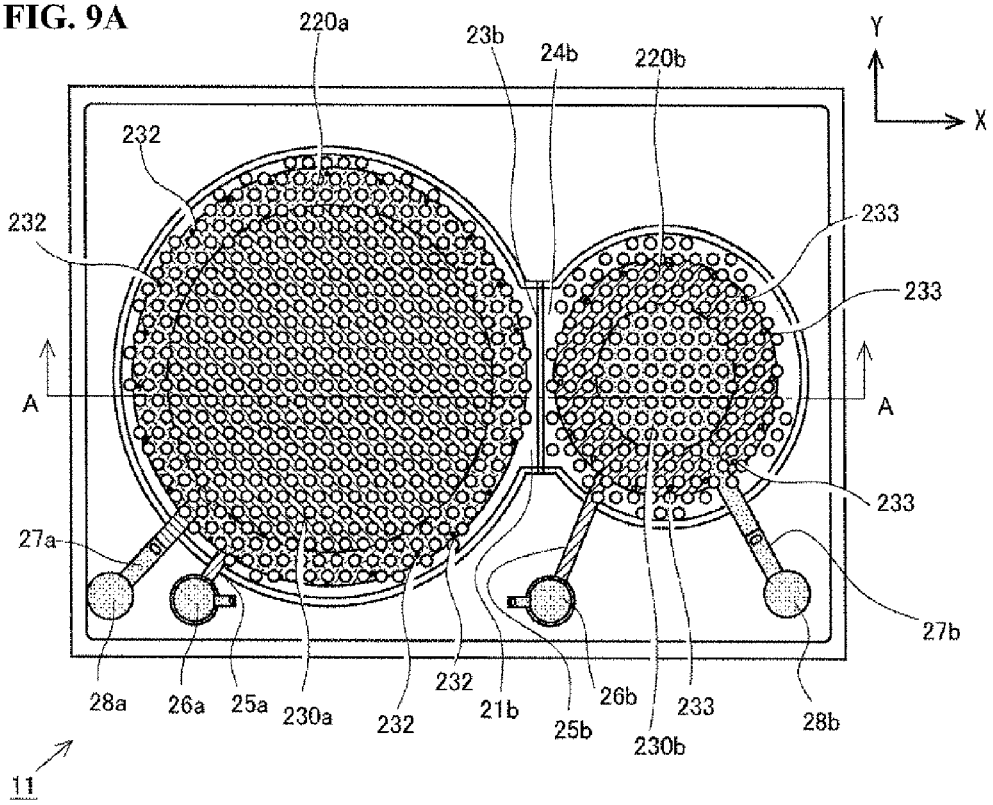
FIGS. 9A and 9B are diagrams showing a schematic configuration of an acoustic transducer according to a sixth embodiment of the present invention, which is installed in the microphone shown in FIGS. 1A to 1C.
Figure 9B:
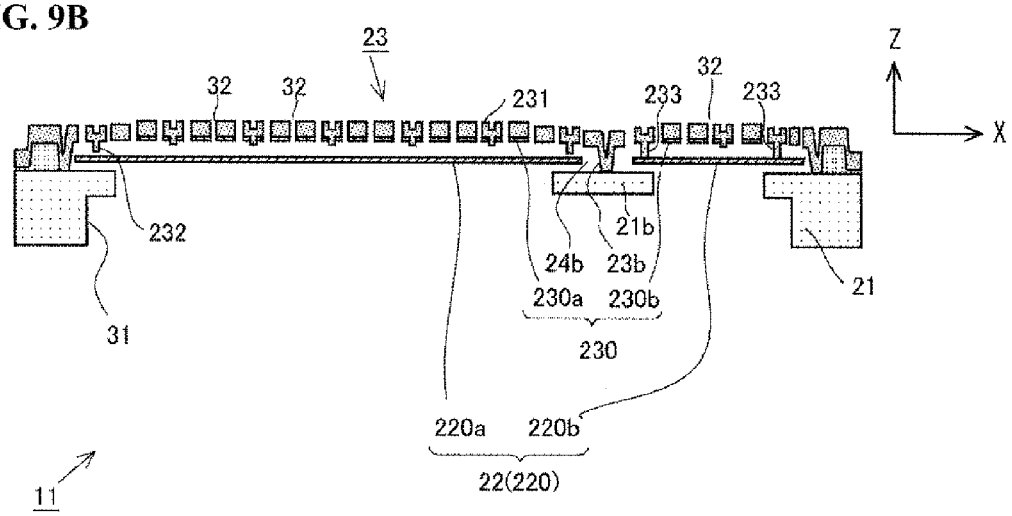

FIGS. 9A and 9B show the schematic configuration of an acoustic transducer 11 according to a sixth embodiment of the present invention. Note that FIG. 9A is a plan view (XY plan view), and FIG. 9B is a ZX cross-sectional diagram taken along a line A-A in FIG. 9A and viewed in the arrow direction. In the acoustic transducer 11 of the sixth embodiment, the first sensing region 220*a* and the second sensing region 220*b* of the vibrating electrode 220 are completely isolated by the space occupied by the isolation groove 24*b*, and the fixed film 23 is joined and supported to the in-opening substrate portion 21*b* via the extension portion 23*b*, likewise to the acoustic transducer of the third embodiment. However, the shapes of the second sensing region 220*b* of the vibrating electrode 220 and the low sensitivity side region 230*b* of the fixed electrode 230 are different from the configurations in the third embodiment. In view of this, the same reference numbers will be used for configurations that are similar to those in one or more of the above embodiments, and detailed descriptions will not be given for them.

In the acoustic transducer 11 of the present sixth, the second sensing region 220*b* of the vibrating electrode 220 and the low sensitivity side region 230*b* of the fixed electrode 230 that form the low-sensitivity capacitor are formed so as to be substantially circular. Note that the first sensing region 220*a* of the vibrating electrode 220 and the high sensitivity side region 230*a* of the fixed electrode 230 are circular similarly to one or more of the previous embodiments. Forming the second sensing region 220*b* so as to be circular in this way makes it less likely for localized stress concentration to occur during vibration. In particular, since the low-sensitivity capacitor detects sound waves with a high sound pressure, it is advantageous to avoid stress concentration during vibration.

While the invention has been described with respect to a limited number of embodiments, those skilled in the art, having benefit of this disclosure, will appreciate that other embodiments can be devised which do not depart from the scope of the invention as disclosed herein. Accordingly, the scope of the invention should be limited only by the attached claims.

The invention claimed is:

1. An acoustic transducer comprising:

a vibrating film and a fixed film formed above an opening portion of a substrate; and at least a first sensing portion and a second sensing portion that detect sound waves using change in capacitance between a vibrating electrode provided in the vibrating film and a fixed electrode provided in the fixed film, convert the sound waves into electrical signals, and output the electrical signals, wherein, in the first sensing portion and the second sensing portion, the fixed film is used in common, and the vibrating electrode is divided into a first sensing region and a second sensing region that respectively correspond to the first sensing portion and the second sensing portion, wherein, in the first sensing portion, a protrusion portion that protrudes toward the vibrating electrode is provided on a region of the fixed film that opposes the first sensing region, wherein, when voltage is applied between the fixed electrode and the vibrating electrode, the vibrating film comes into contact with the protrusion portion such that the first sensing region of the vibrating electrode is relatively fixed to the fixed film in a state in which an air gap that is a first predetermined gap is formed between the fixed electrode and the vibrating electrode, and when the voltage application is canceled, the relative fixed state of the first sensing region is also canceled, wherein, in the second sensing portion, the vibrating film in the second sensing region is fixed to the substrate or the fixed film in a state in which an air gap that is a second predetermined gap is formed between the fixed electrode and the vibrating electrode, and wherein in the second sensing portion, regardless of voltage application between the fixed electrode and the vibrating electrode, the vibrating film in the second sensing region is fixed in a state of being constantly joined to the substrate or the fixed film in a state in which the air gap that is the second predetermined gap is formed.

2. The acoustic transducer according to claim 1, wherein a sensitivity to sound pressure in the first sensing portion is higher than a sensitivity to sound pressure in the second sensing portion.

3. The acoustic transducer according to claim 1, wherein the first sensing region and the second sensing region are divided by a slit provided in the vibrating electrode in a state in which the first sensing region and the second sensing region are connected via a connection portion, and wherein the slit enables the first sensing region to approach the fixed film due to voltage application between the fixed electrode and the vibrating electrode.

4. The acoustic transducer according to claim 3, wherein the first sensing region and the second sensing region are electrically short-circuited.

5. The acoustic transducer according to claim 1, wherein the first sensing region and the second sensing region of the vibrating electrode are divided by an isolation groove space formed therebetween so as to be independent of each other, and wherein the first sensing region is configured to approach the fixed film independently of the second sensing region when voltage is applied between the fixed electrode and the vibrating electrode.

6. The acoustic transducer according to claim 5, wherein an in-opening substrate portion that is a portion of the substrate is arranged at a position that is inside the opening portion and opposes the isolation groove space, and so as to cover the isolation groove space.

7. The acoustic transducer according to claim 6, wherein the in-opening substrate portion is electrically connected to the first sensing region and the second sensing region.

8. The acoustic transducer according to claim 6, wherein the vibrating film and the fixed film are arranged in the stated order above the opening portion, and wherein the fixed film is fixed in a state of being constantly joined to the in-opening substrate portion via the isolation groove space that divides the vibrating electrode.

9. The acoustic transducer according to claim 1, wherein at least one of the first sensing region and the second sensing region is formed so as to be circular.

10. The acoustic transducer according to claim 1, wherein at least one of the first sensing region and the second sensing region is formed so as to be rectangular.

11. The acoustic transducer according to claim 1, wherein the area of the first sensing region is larger than the area of the second sensing region.

12. The acoustic transducer according to claim 1, wherein the first predetermined gap and the second predetermined gap have the same length.

13. A microphone comprising:

the acoustic transducer according to claim 1; and a circuit portion that supplies power to the acoustic transducer for voltage application between the fixed electrode and the vibrating electrode, and amplifies an electrical signal that corresponds to detected sound waves from the acoustic transducer.

14. An acoustic transducer comprising:

a vibrating film and a fixed film formed above an opening portion of a substrate; and at least a first sensing portion and a second sensing portion that detect sound waves using change in capacitance between a vibrating electrode provided in the vibrating film and a fixed electrode provided in the fixed film, convert the sound waves into electrical signals, and output the electrical signals, wherein, in the first sensing portion and the second sensing portion, the fixed film is used in common, and the vibrating electrode is divided into a first sensing region and a second sensing region that respectively correspond to the first sensing portion and the second sensing portion, wherein, in the first sensing portion, a protrusion portion that protrudes toward the vibrating electrode is provided on a region of the fixed film that opposes the first sensing region, wherein, when voltage is applied between the fixed electrode and the vibrating electrode, the vibrating film comes into contact with the protrusion portion such that the first sensing region of the vibrating electrode is relatively fixed to the fixed film in a state in which an air gap that is a first predetermined gap is formed between the fixed electrode and the vibrating electrode, and when the voltage application is canceled, the relative fixed state of the first sensing region is also canceled, wherein, in the second sensing portion, the vibrating film in the second sensing region is fixed to the substrate or the fixed film in a state in which an air gap that is a second predetermined gap is formed between the fixed electrode and the vibrating electrode, wherein the first sensing region and the second sensing region of the vibrating electrode are divided by an isolation groove space formed therebetween so as to be independent of each other, wherein the first sensing region is configured to approach the fixed film independently of the second sensing region when voltage is applied between the fixed electrode and the vibrating electrode, and wherein an in-opening substrate portion that is a portion of the substrate is arranged at a position that is inside the opening portion and opposes the isolation groove space, and so as to cover the isolation groove space.

15. The acoustic transducer according to claim 14, wherein the in-opening substrate portion is electrically connected to the first sensing region and the second sensing region.

16. The acoustic transducer according to claim 14, wherein the vibrating film and the fixed film are arranged in the stated order above the opening portion, and wherein the fixed film is fixed in a state of being constantly joined to the in-opening substrate portion via the isolation groove space that divides the vibrating electrode.

* * * * *